US007222631B2

(12) United States Patent
Silva

(10) Patent No.: US 7,222,631 B2
(45) **Date of Patent: *May 29, 2007**

(54) CLAW CLIP HAIR FASTENER

(76) Inventor: David Alan Silva, 2314 Lafayette St., Santa Clara, CA (US) 95050

( * ) Notice: Subject to any disclaimer, the term of this patent is extended or adjusted under 35 U.S.C. 154(b) by 0 days.

This patent is subject to a terminal disclaimer.

(21) Appl. No.: 10/892,901

(22) Filed: Jul. 17, 2004

(65) Prior Publication Data

US 2004/0255968 A1 Dec. 23, 2004

Related U.S. Application Data

(62) Division of application No. 10/133,067, filed on Apr. 26, 2002, now abandoned.

(51) Int. Cl.
*A45D 8/20* (2006.01)
*A45D 24/00* (2006.01)

(52) U.S. Cl. ..... 132/277; 132/200

(58) Field of Classification Search ..... 132/273, 132/275, 277, 128, 64.1, 53–55, 276, 278, 132/279, 200; D28/39–41; 24/300, 301, 24/485, 510, 565

See application file for complete search history.

(56) References Cited

U.S. PATENT DOCUMENTS

| | | | | | |
|---|---|---|---|---|---|
| 206,388 | A * | 7/1878 | Brown | 24/510 |
| 245,103 | A * | 8/1881 | Vickars | 24/485 |
| 689,811 | A * | 12/1901 | Brownley | 24/332 |
| 1,373,619 | A * | 4/1921 | Kohn | 24/331 |
| 2,712,319 | A * | 7/1955 | Roitner | 132/129 |
| 5,473,796 | A * | 12/1995 | Fusillo | 24/30.5 R |
| 5,787,905 | A * | 8/1998 | Yasuda | 132/277 |
| 6,098,636 | A * | 8/2000 | Curtiss et al. | 132/277 |
| 6,453,911 | B1 * | 9/2002 | Silva | 132/275 |
| 6,612,312 | B2 * | 9/2003 | Silva | 132/200 |
| 6,691,717 | B2 * | 2/2004 | Silva | 132/275 |

* cited by examiner

*Primary Examiner*—Robyn Doan

(57) ABSTRACT

A multiple clip hair fastener with a plurality of claw clips directly attached to the next. The clips are fastened to separate sections of hair while each clip remains directly attached.

1 Claim, 3 Drawing Sheets

CLAW CLIP HAIR FASTENER

This is a division of application Ser. No. 10/133,067 filed Apr. 26, 2002 now abandoned.

BACKGROUND OF THE INVENTION

1. Field of the Invention

The present invention and method relates to a claw clip hair fastener. More particularly a plurality of claw clips connected directly to each other in various formations to create a multitude of new hairstyles.

2. Description of Prior Art

Many people like to put their hair up in various styles. One way to put the hair up is to clip a plurality of sections of hair and secure them with individual hair clips. This process is effective and stylish but it is difficult for a non-hairstylist to achieve, especially when trying to keep the clips in alignment. It is also a time consuming process.

SUMMARY OF THE PRESENT INVENTION

An object of the present invention is to provide an instrument, which is convenient, practical, and inexpensive for use in hair styling.

A further object is to provide an instrument that will keep a plurality of claw clips neatly attached.

A further object is to provide a single instrument that will keep a plurality of hair sections neatly aligned.

A further object is to provide a single instrument that will keep a plurality of hair sections neatly secure to a single device.

A further object is to provide such an instrument that can be used unassisted by the individual styling their hair, eliminating the expense of a professional stylist.

A further object is to provide an instrument that can be reused over and over again. A further object is to provide an instrument that will quickly hold the user's hair up in a neatly secured style.

According to the preferred embodiment of the present invention, there is provided a multiple claw clip hair fastener comprising a plurality of claw clips attached directly to each other in various formations. The clips are the "bulldog" type, wherein the gripping arms of the clips bend in a direction away from the clips pivot in a concave sense.

According to the arrangement described above a first claw clip is secured to a section of hair. Other sections of hair are then secured to the other remaining claw clips. As you will see below the claw clips can be attached together in different formations allowing the hair sections to be put in the claw clips at different angles while all clips remain directly attached. Because all the claw clips are directly attached and aligned with each other, the hair sections remain in conveniently separate sections within a single apparatus while the clips stay attached.

Accordingly a preferred embodiment is a plurality of spring loaded plastic claw clips directly attached. The clips are either aligned one after another or are attached in alternating directions. Each clip is connected at their edge portion. The clips may be snap-locked together, which would make them removably connected or simply attached together permanently. Latches, hinges, or ball and joint could connect them.

Other objects, features and advantages of the present invention will become apparent from the following description of the preferred embodiments given with reference to the accompanying drawings.

DETAILED DESCRIPTION OF THE PREFERRED EMBODIMENTS

Figure 1:
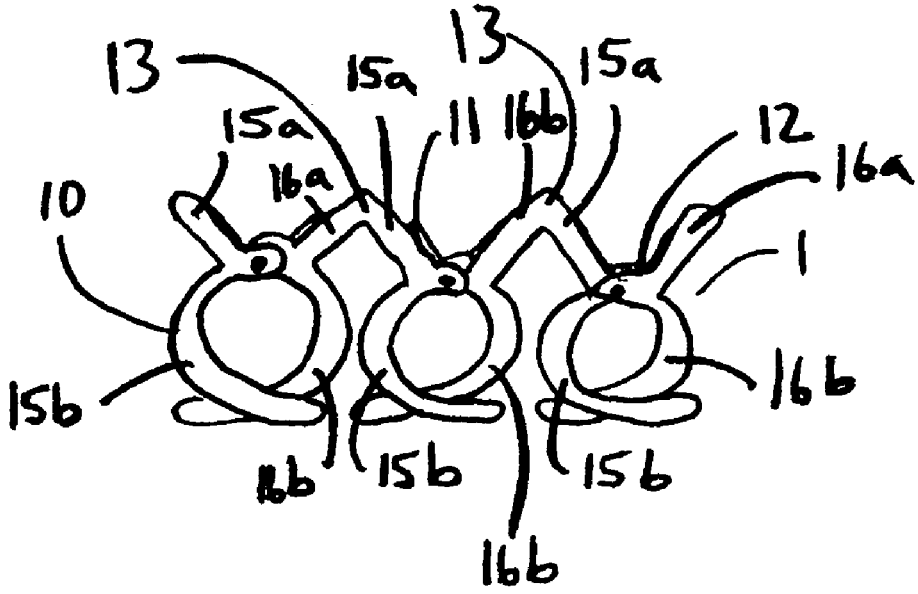
FIG. 1 is a plan view showing the multiple claw-clips attached to each other according to the present invention.
Figure 2:
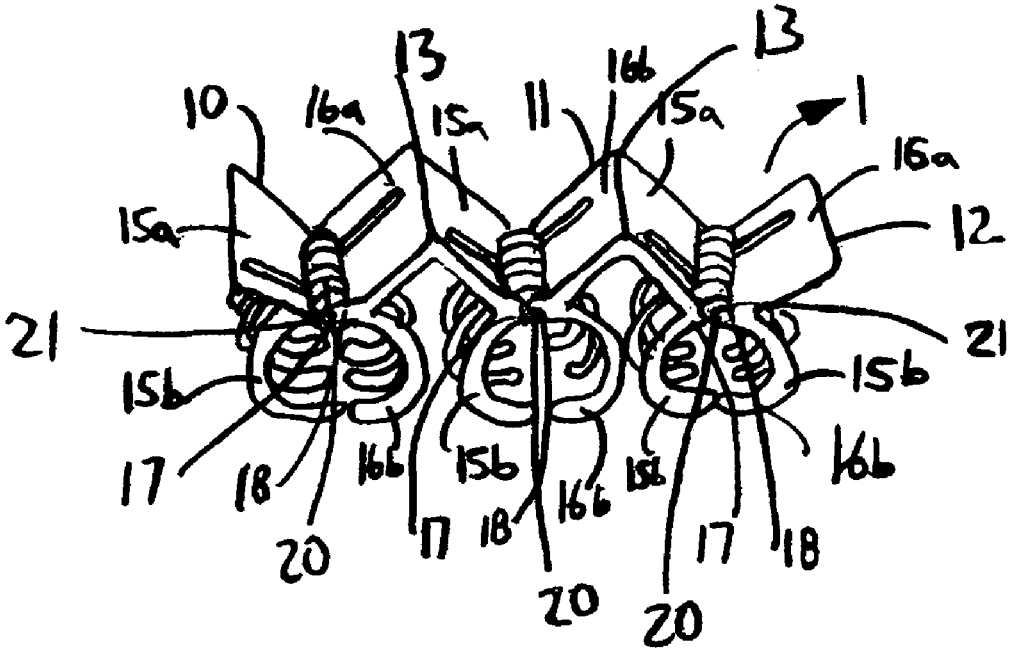
FIG. 2 is a perspective view showing the multiple claw-clips attached to each other according to the present invention.

Referring to FIGS. 1 and 2 of the accompanying drawings. There is illustrated the multiple clip fastener embodying the present invention. The multiple clip fastener, generally designated by reference numeral 1, shows a plurality of attached clips. The clips 10, 11, and 12 have a first claw and handle portion 15*a* with teeth 15*b* penetrating from claw and handle portion 15*a* and a second claw and handle portion 16*a* with teeth 16*b* penetrating from claw and handle portion 16*a*, the teeth 15(*b*) and 16(*b*) being mutually intertwined as shown in FIG. 1. Each portion 15*a* and 16*a* has a pair of lugs 17 and 18. The lugs 17 and 18 are aligned with a spring 19 intermediate them and a pin 20 is placed through holes 21 and 22 of lugs 17 and 18. Wherein the first claw and handle portion 15*a* is secured to the second claw and handle portion 16*a*. Each clip 10, 11, and 12 is attached to the next between clips 10 and 11 and between clips 11 and 12 at 13. Preferably the clip portions 10, 11, and 12 are made of plastic.

In use of the multiple clip fastener 1 described above, the center clip 11 can be clamped to a section of hair by using the clips 10 and 12 as the open and close handles. The first and third clip 10 and 12 are then attached to a second and third hair section.

Figure 3:
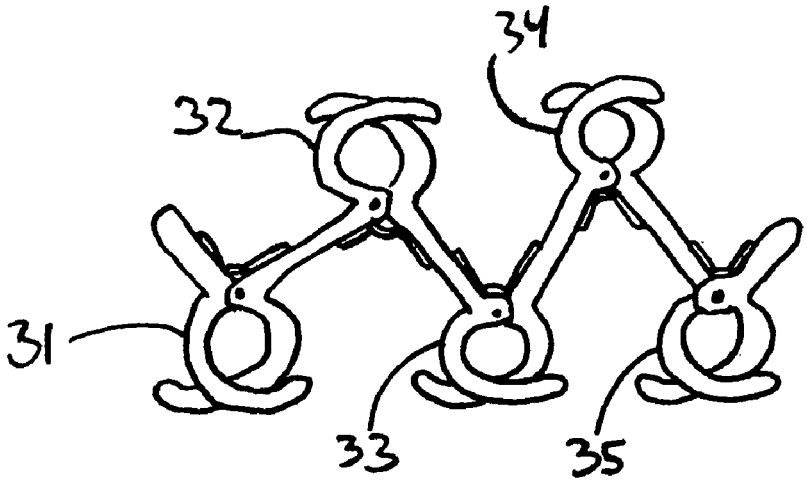
FIG. 3 is a plan view of another embodiment of the current invention.

FIG. 3 shows clips 30, 31, 32, 33, 34, and 35 connected with the clips facing alternate directions so hair sections can be grabbed from different sides.

Figure 4:
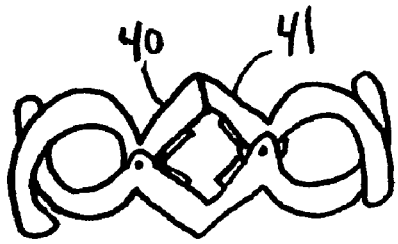
FIG. 4 is a plan view of another embodiment of the current invention.

FIG. 4 shows two clips 40 and 42 attached back to back.

Figure 5:
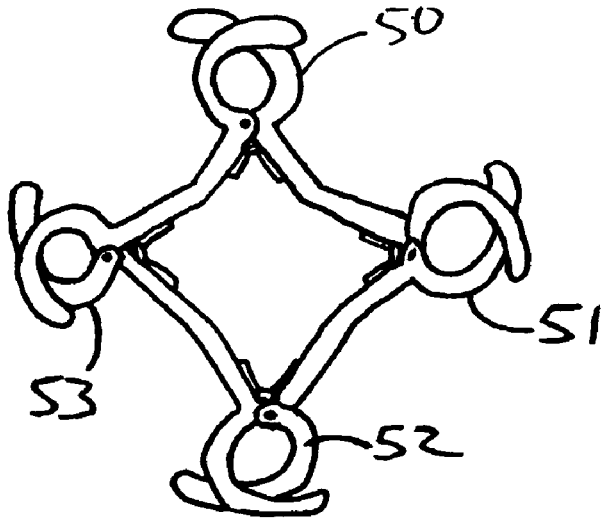
FIG. 5 is a plan view of another embodiment of the current invention.

FIG. 5 shows clips 50, 51, 52, and 53 attached in a circular sense.

Figure 6:
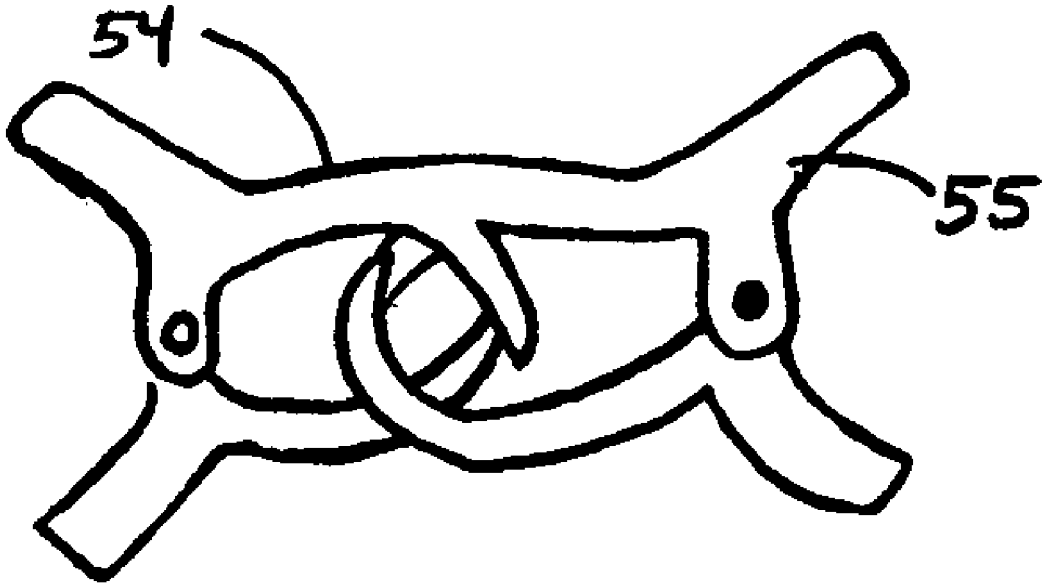
FIG. 6 is a plan view of another embodiment of the current invention.

FIG. 6 shows clips 54 and 55 attached face to face.

The present invention being thus described, any other way to use the current invention should apply. Such variations in use are not to be regarded as a departure from the spirit and scope of the invention, and all such variations as would be obvious to those skilled in the art are intended to be included within the scope of the claims.

The invention claimed is:

1. A method of securing and styling hair comprising steps of:

selecting a multiple hair clip fastener wherein the hair clip fastener comprising three claw clips, each of said claw clip having a pair of jaws including a mutual pivotal connection, each of said jaws having an edge portion spaced from said pivotal connection, each edge portion having gripping teeth that are mutually intertwined, said edge portion and said gripping teeth being bent in a concave sense in a direction away from said pivotal connection, wherein each of said claw clips further comprises spring means which urges said edge portion of said jaws together and said gripping teeth into mutually intertwined engagement; each of said clips also comprises a pair of handles disposed on the side of said spring means remote from said jaws, wherein each of said claw clips being permanently attached to each other thereby forming an intermediate clip and two outer clips, using said outer clips as open and close handles to open said intermediate clip, closing said intermediate clip about a first section of hair, opening one of said outer clips and securing one of said outer clips around a second section of hair and opening the other of said outer clips and securing the other of said outer clips around a third section of hair.

* * * * *